US007374590B2

(12) United States Patent
Holcomb

(10) Patent No.: US 7,374,590 B2
(45) Date of Patent: May 20, 2008

(54) REDUCING SULFUR DIOXIDE EMISSIONS FROM COAL COMBUSTION

(75) Inventor: Robert R. Holcomb, Nashville, TN (US)

(73) Assignee: Demeter Systems LLC, Orlando, FL (US)

( * ) Notice: Subject to any disclaimer, the term of this patent is extended or adjusted under 35 U.S.C. 154(b) by 649 days.

(21) Appl. No.: 10/473,871

(22) PCT Filed: Mar. 28, 2002

(86) PCT No.: PCT/US02/10151

§ 371 (c)(1),
(2), (4) Date: Apr. 6, 2004

(87) PCT Pub. No.: WO02/079356

PCT Pub. Date: Oct. 10, 2002

(65) Prior Publication Data

US 2004/0154220 A1 Aug. 12, 2004

Related U.S. Application Data

(60) Provisional application No. 60/279,325, filed on Mar. 28, 2001.

(51) Int. Cl.
*C10L 5/00* (2006.01)

(52) U.S. Cl. ..... 44/620; 44/622; 44/624

(58) Field of Classification Search ..... 44/620, 44/621, 622, 624

See application file for complete search history.

(56) References Cited

U.S. PATENT DOCUMENTS

| | | | | |
|---|---|---|---|---|
| 4,066,471 | A | 1/1978 | Burke | |
| 4,155,716 | A * | 5/1979 | Sun et al. | 44/624 |
| 4,161,440 | A | 7/1979 | Brunson | |
| 4,303,505 | A | 12/1981 | Capes et al. | |
| 4,448,585 | A | 5/1984 | Yoo | |
| 4,783,197 | A | 11/1988 | Mathiesen et al. | |
| 5,047,222 | A * | 9/1991 | Rochelle et al. | 423/243.1 |
| 5,368,617 | A * | 11/1994 | Kindig | 44/622 |
| 5,537,363 | A | 7/1996 | Holcomb | |
| 6,416,672 | B1 | 7/2002 | Midkiff | |
| 7,056,359 | B1 * | 6/2006 | Somerville et al. | 44/604 |
| 2001/0027219 | A1 | 10/2001 | Holcomb | |

FOREIGN PATENT DOCUMENTS

| | | | |
|---|---|---|---|
| GB | 2009783 | A | 6/1979 |

* cited by examiner

*Primary Examiner*—Cephia D. Toomer
(74) *Attorney, Agent, or Firm*—Garvey, Smith, Nehrbass & North, L.L.C.; Gregory C. Smith

(57) ABSTRACT

A process of treating high sulfur coal to reduce sulfur dioxide emission when the high sulfur coal is burned comprising placing coal in pressure tank (16) of reduced pressure sufficient to fracture a portion of the coal by withdrawing ambient fluids trapped within the coal. The fractured coal is contacted with an aqueous silica colloid composition supersaturated with calcium carbonate via conduit (21), and the majority of the aqueous composition is then removed from contact with the coal. The aqueous composition-treated coal is pressurized in pressure tank (16) under a carbon dioxide atmosphere for a period of time sufficient for the calcium carbonate to enter fractures in the coal produced in the first step.

17 Claims, 7 Drawing Sheets

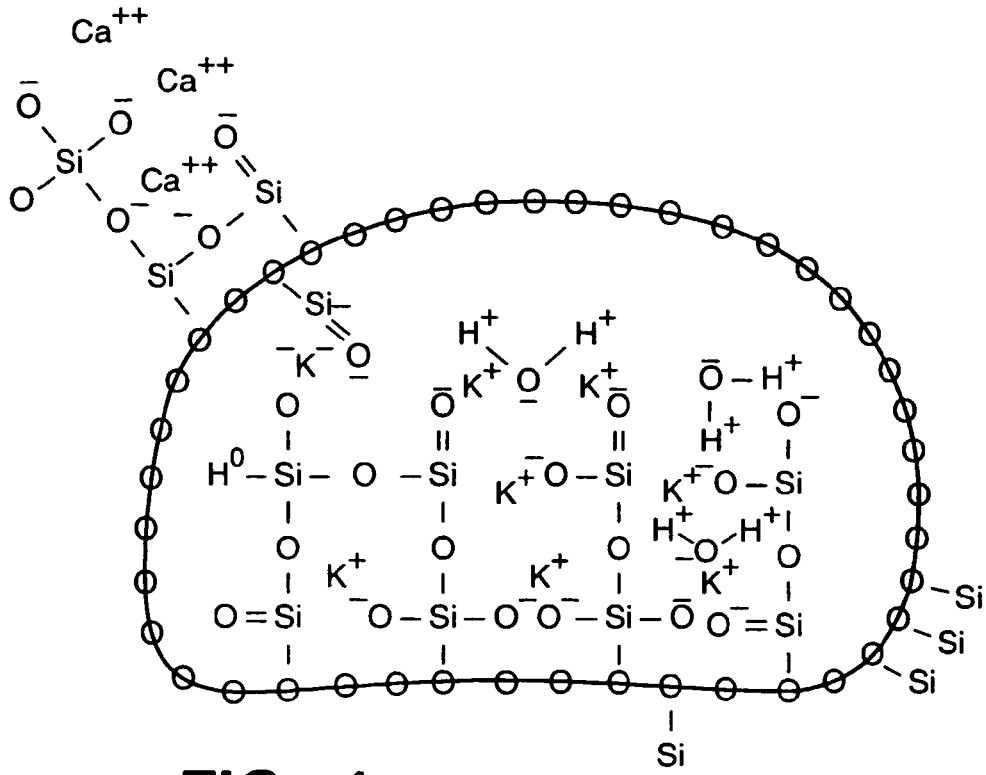
Ca++
Ca++
Ca++
Si
Si
Si

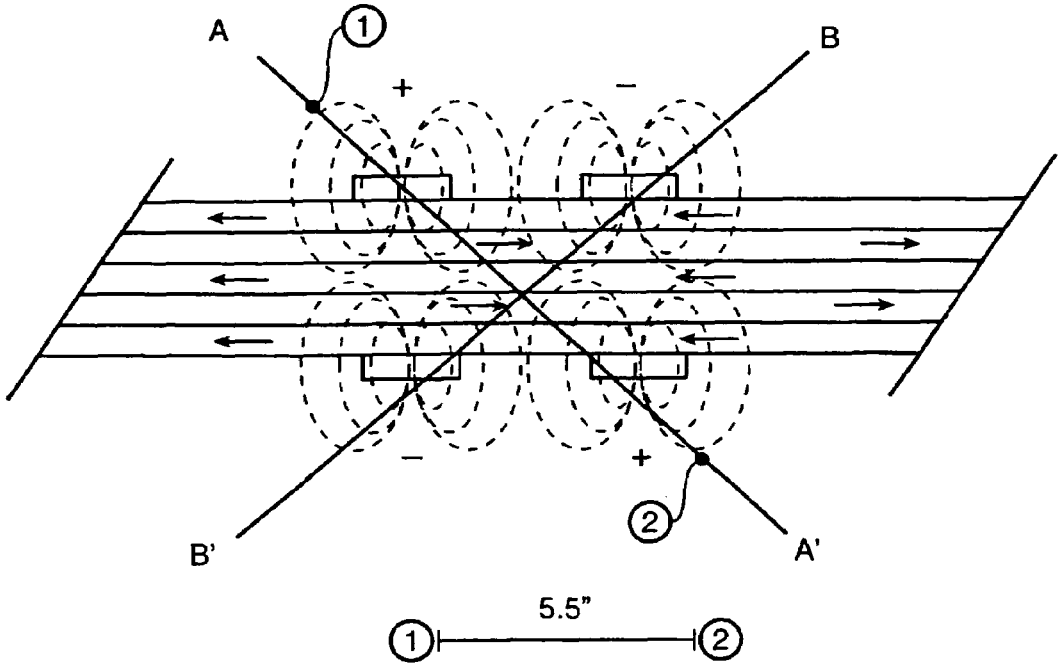
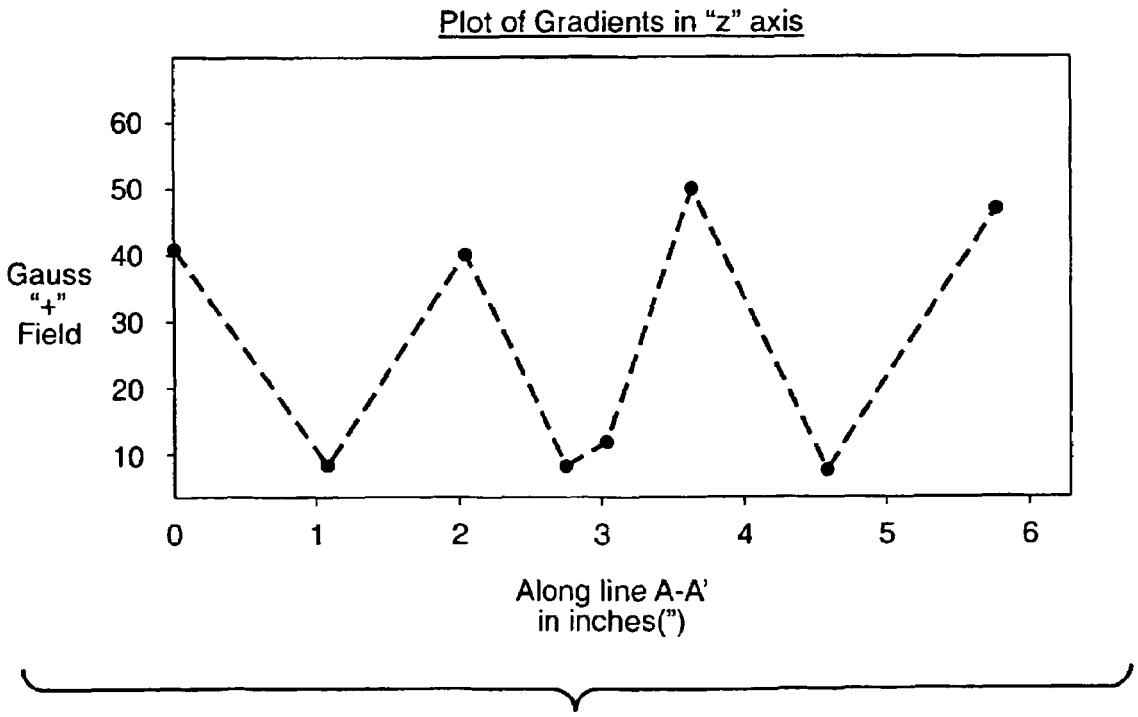
FIG._5

REDUCING SULFUR DIOXIDE EMISSIONS FROM COAL COMBUSTION

CROSS REFERENCE TO RELATED APPLICATIONS

This patent application claims priority to U.S. provisional application No. 60/279,325 to Holcomb filed on Mar. 28, 2001 and entitled, "Apparatus and Process for Treating Coal which is High in Sulfur such that it will Burn in a High Temperature Furnace with Greatly Reduced Emissions of Sulfur Dioxide ($SO_2$), Nitrous Oxide and Mercury." which is incorporated in its entirety herein by reference.

FIELD OF THE INVENTION

The present invention relates generally to coal. More particularly, the present invention relates to treating coal to reduce sulfur dioxide emissions during coal combustion.

GENERAL BACKGROUND

Coal is one of the most bountiful sources of fuel in the world. Coal is typically found as a dark brown to black graphite-like material that is formed from fossilized plant matter. Coal generally comprises amorphous carbon combined with some organic and inorganic compounds. The quality and type of coal varies from high quality anthracite (i.e., a high carbon content with few volatile impurities and bums with a clean flame) to bituminous (i.e., a high percentage of volatile impurities and bums with a smoky flame) to lignite (i.e., softer than bituminous coal and comprising vegetable matter not as fully converted to carbon and bums with a very smoky flame). Coal is burned in coal-fired plants throughout the world to produce energy in the form of electricity. Over the years it has been recognized that certain impurities in coal can have a significant impact on the types of emissions produced during coal combustion. A particularly troublesome impurity is sulfur. Sulfur can be present in coal from trace amounts up to several percentages by weight (e.g., 7 percent by weight). Sulfur may be found in coal in various forms, e.g., organic sulfur, pyritic sulfur, or sulfate sulfur. When coal containing sulfur is burned, sulfur dioxide ($SO_2$) is typically released into the atmosphere in the combustion gases. The presence of $SO_2$ in the atmosphere has been linked to the formation acid rain, which results from sulfuric or sulfurous acids that form from $SO_2$ and water. Acid rain can damage the environment in a variety of ways, and, in the United States, the Environment Protection Agency (EPA) has set standards for burning coal that restricts $SO_2$ emissions from coal-fired plants.

While coal is produced in the United States in many areas of the country, much of the coal that is easily mined (and therefore inexpensive) often contains high levels of sulfur that result in levels of $SO_2$ in the combustion gases greater than allowed by the EPA. Thus, coal-fired plants often must buy higher quality coal from mines that may be located long distances from the plants and pay significant transportation and other costs. A significant body of technology has been developed over time to reduce the amount of $SO_2$ in combustion gases from burning high sulfur coal. This technology has involved treatments to coal during pre-combustion, during combustion, and during post-combustion. However, such treatments have generally not achieved a satisfactory combination of efficacy in reducing $SO_2$ emissions and economic feasibility in implementation.

It is against this background that a need arose to develop the present invention.

SUMMARY OF THE INVENTION

One aspect of this invention is a process for treating high sulfur coal to reduce sulfur dioxide emissions when the coal is burned. The method comprises:

(a) placing the coal in an environment of reduced pressure sufficient to fracture a portion of the coal by withdrawing ambient fluids trapped within the coal, (b) contacting the fractured coal with an aqueous silica colloid composition supersaturated with calcium carbonate, (c) removing the majority of the aqueous composition from contact with the coal, and (d) pressurizing the aqueous composition-treated coal under a carbon dioxide atmosphere for a period of time sufficient for the calcium carbonate to enter fractures in the coal produced in step (a).

Another aspect of this invention is a high sulfur coal, wherein the coal is vacuum fractured, comprises at least about 0.5 percent by weight sulfur, and further comprises calcium carbonate deposited within fractures in the coal in an amount sufficient to provide a Ca:S molar ratio of at least 0.5.

Another aspect of this invention is a process for producing energy from burning high sulfur coal while reducing the sulfur dioxide content of the emission from such burning, which process comprises depositing calcium carbonate within fractures in vacuum-fractured coal and burning the resulting calcium carbonate-containing high sulfur coal at a high temperature.

Still another aspect of this invention is a process for increasing the amount of calcium sulfate produced as a result of burning high sulfur coal, while at the same time reducing the sulfur dioxide emissions from such burning, which process comprises burning a vacuum fractured high sulfur coal having calcium carbonate deposited within fractures in the coal and recovering the calcium sulfate produced as a result of such burning.

A further aspect of this invention is an aqueous composition suitable for treating high sulfur coal to reduce the sulfur dioxide emissions when the treated coal is burned. The composition comprises a supersaturated solution of calcium carbonate integrated with an alkaline aqueous silica colloid composition.

A still further aspect of this invention is a process for making an aqueous composition suitable for treating high sulfur coal to reduce the sulfur dioxide content of the combustion products when the treated coal is burned, which process comprises dissolving calcium carbonate in a strong aqueous alkaline, colloidal silica composition under conditions sufficient to integrate calcium ions into the silica-derived colloidal particles to form a supersaturated solution of calcium carbonate.

A final aspect of this invention is an apparatus for treating high sulfur coal with an aqueous composition under pressure, which apparatus comprises:

a pressurizable container suitable for holding the coal, a first inlet to allow the aqueous composition to enter the container and to contact with the coal, a mechanism to remove the aqueous composition from the container, a first inlet to allow carbon dioxide to enter the container under a pressure higher than atmospheric pressure, a source of pressurized carbon dioxide connected to the first inlet, and an outlet to remove the coal from the container.

Other aspects of the invention may be apparent to one of skill in the art upon reading the detailed description of this invention.

BRIEF DESCRIPTION OF THE DRAWINGS

For further understanding of the nature, objects and advantages of the present invention, reference should be had to the following detailed descriptions, read in conjunction with the following drawings, wherein like reference numerals denote like elements and wherein:

FIG. 1 is a representation of the believed structure of silica colloidal particles in which $Ca^{+2}$ ions are sequestered, according to an embodiment of the invention.

FIG. 2 is a representation of a double layer of water associated with a typical silica colloidal particle formed in accordance with an embodiment of the invention.

FIG. 5 is a top cross sectional view of the generator of FIG. 4 along with magnetic fields and magnetic field gradients, according to an embodiment of the invention.

DETAILED DESCRIPTION OF THE INVENTION

Figure 3:
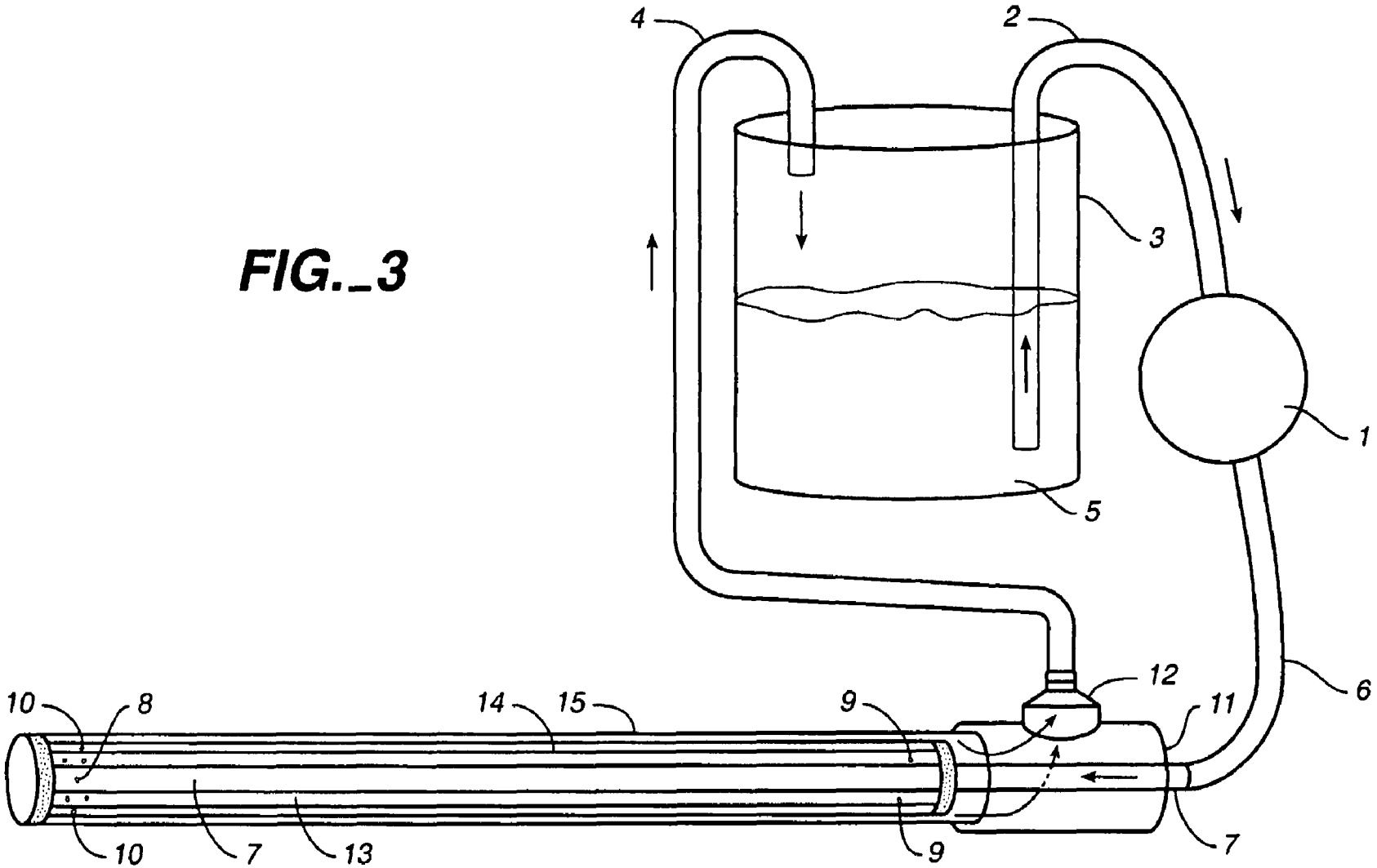
FIG. 3 is a representation of a generator according to an embodiment the invention.

Embodiments of the invention provide an approach for reducing $SO_2$ and other harmful combustion gases by a unique pre-combustion treatment of coal. Coal may be treated with an aqueous silica colloid composition supersaturated with calcium carbonate, preferably associated with calcium oxide, to significantly increase the amount of calcium (Ca) in the treated coal relative to an untreated coal (e.g. a naturally occurring coal). More particularly, a vacuum may be applied to coal to remove fluids from the coal and fracture the coal. The fractured coal may then be contacted with the aqueous composition under pressure of carbon dioxide ($CO_2$). This process is thought to allow a portion of the aqueous composition to penetrate the fractures in the coal, such that calcium carbonate will crystallize within the fractures and further fracture the coal. When this treated coal is burned, sulfur is converted to $CaSO_4$ and $Na_2SO_4$ as the coal burns at high temperatures by a chemical reaction between calcium carbonate, $NaHCO_3$, and sulfur dioxide-sulfuric acid and/or sulfurous acid. The advantage is that the coal bums with low sulfur dioxide ($SO_2$) emissions. In addition there is evidence for lower emissions of nitrogen oxides ($NO_x$), mercury (Hg), carbon monoxide (CO), carbon dioxide ($CO_2$) and hydrocarbons (HC). At the same time that the quality of the combustion emissions is improved, the solid by-products of the combustion process are modified to increase amounts of useful solids that can be collected. In particular, the ash provides a component ($CaSO_4$) useful in manufacture of cement.

One embodiment of the invention is a process for treating coal to reduce sulfur dioxide emissions when the coal is burned. In a first step, the coal is placed in an environment of reduced pressure sufficient to fracture a portion of the coal by withdrawing ambient fluids trapped within the coal. In a second step, the coal is contacted with an aqueous silica colloid composition supersaturated with calcium carbonate. In a third step, the aqueous composition is removed from contact with the coal. In a fourth step, the coal is pressurized under a carbon dioxide atmosphere for a period of time sufficient for the calcium carbonate to enter fractures in the coal produced in the first step.

The type of coal that can be treated by this process is any coal that has an undesirable level of sulfur that will result in undesirable or illegal levels of $SO_2$ if burned without treatment. Thus, the coal may be anthracite, bituminous or lignite that has a sulfur content of about 0.2 percent by weight up to more than 7 percent by weight. For certain applications, a coal having a sulfur content of at least 0.5 percent by weight may be viewed as a high sulfur coal. The density of the coal often depends on the type of coal and typically varies from about 1.2 g/cm$^3$ to 2.3 g/cm$^3$ (e.g., apparent density as measured by liquid displacement). The size of the coal that is treated at the depressurization stage may be the size that comes out of most mines, e.g., an irregular shape with a maximum cross sectional size of about 2 inches down to less than about ¼ inch. The size that works for large stoker burners is about ¾-1 inch, while the size that works for small stoker burners is less than about ½ inch. Thus, the process may be used at a processing plant near where the coal is to be burned or right at the mining site. If desired, the coal may be reduced in size prior to depressurization by, for example, crushing, grinding or pulverizing the coal into a powder of particles having sizes less than about 5 cm, e.g., less than 3 cm, with sizes in the range of 50 μm to 300 μm or from 50 μm to 100 μm being desirable for certain applications. This reduction in size of the coal may serve to increase surface area that can be exposed to depressurization and to the aqueous composition and may serve to reduce the amount of time required to process the coal. If desired, the coal that has been reduced in size may be mixed with a liquid (e.g., water) to form a slurry. For certain applications, it may be desirable to contact the coal with calcium oxide prior to depressurization by, for example, mixing the coal with calcium oxide in a powdered form. Contacting the coal with the calcium oxide may serve to further reduce $SO_2$ emissions.

In the first step discussed above, the coal is placed in a container that can be sealed and depressurized. The depressurization will be sufficient to remove fluids, whether gaseous or liquid, entrapped in the coal. This is believed to result in fracturing the coal, i.e. creating fractures in the form of small cracks, faults, or channels in the coal. Alternatively or in conjunction, the depressurization may serve to remove fluids, whether gaseous or liquid, entrapped within pre-existing fractures in the coal. The fractures, whether created by depressurization or pre-existing, are typically elongated and may be inter-connected or may be spaced apart in a generally parallel manner. The fractures should be in adequate numbers and cross section sizes to allow a sufficient amount of the aqueous composition supersaturated with calcium carbonate to penetrate the fractures. For instance, the depressurization may create numerous fractures in the coal that have cross section sizes in the range of 0.01 μm to 1 μm. The depressurization generally takes place at ambient temperature, although the coal could be heated to aid in the process. The pressure is reduced to less than ambient, atmospheric pressure, e.g., to about a tenth of an atmosphere or less, depending on the strength of the vacuum pump used. Generally the length of time the coal will be depressurized is typically less than an hour, e.g. less than about 15 minutes, with about 3-10 minutes being sufficient for many applications.

Once the coal has been depressurized, it is then contacted with the aqueous silica colloid composition supersaturated with calcium carbonate for a time sufficient to infuse the fractures with the dissolved calcium carbonate. It is thought that this results in intimately associating the calcium carbonate with the coal and further fracturing of the coal through crystallization of the calcium carbonate within the fractures. To enhance the fracturing of the coal, it may be desirable that the aqueous composition also comprise calcium oxide. The contacting step takes place at ambient temperature for ease of process, although elevated temperatures could be used. Generally the amount of the aqueous composition used will be from about 5 gallons to about 20 gallons or more per one hundred pounds of coal. For scales of economy about 10 gallons per one hundred pounds of coal typically will be used. The aqueous composition may be sprayed or poured on the coal in the container, and the coal may be immersed (e.g., fully immersed) in the aqueous composition. If desired, the coal can be stirred or agitated to intimately mix with the aqueous composition. Generally, only a few minutes will be needed to add the aqueous composition to the coal under ambient temperature and pressure. Further details regarding the aqueous composition will be discussed hereinafter.

Once the aqueous composition is in contact with the coal for a sufficient amount of time, the container in which the coal is located is pressurized with a gas, preferably carbon dioxide, for a time sufficient to force a portion of the aqueous composition into the fractures of the coal, to initiate crystallization of the dissolved calcium carbonate in the fractures, and to further fracture the coal. Preferably, the aqueous composition is removed from contact with the coal prior to the pressurizing step. In particular, a remaining portion (e.g., 70% to 90%) of the aqueous composition that has not penetrated the coal may be removed by a variety of methods, e.g., by filtering the coal or simply flowing the remaining portion of the aqueous composition out of the container through a mesh or sieve.

Generally, the pressurization step will take place at ambient temperature and at a pressure that will exceed 50 pounds per square inch (psi), preferably more than 100 psi. While the pressure may exceed 300 psi, the evidence suggests no more than 300 psi is needed for most applications. The pressurization typically will take place for no more than an hour, generally about 20-45 minutes. Once the pressurization is complete, the coal may be burned or otherwise processed in accordance with any conventional method to extract energy from the coal. If desired, the coal may be reduced in size after treatment by, for example, crushing, grinding or pulverizing the coal into a powder of particles. For certain applications, the coal may be retreated via the same process discussed above. In particular, the steps may be repeated two or more times, but generally no more than two cycles are needed for satisfactory results for the reduction in $SO_2$ emissions. Preferably the filtrate is reused for the next cycle, with fresh aqueous composition being added to provide the desired ratios of aqueous composition to coal, as discussed hereinbefore. It is thought that two cycles provide an adequate infusion of the coal with the calcium carbonate with respect to time and cost considerations.

The treated coal in accordance with the process will have calcium carbonate associated with it so that, when the coal is burned at a high temperature, emission of $SO_2$ is reduced to a desired level. In particular, the treated coal may have a calcium carbonate content such that the molar ratio of Ca to S found in the treated coal is typically at least 0.5, with a ratio of at least 1 (e.g., 1-4) being preferred. This calcium carbonate content may reduce $SO_2$ emissions by at least about 5 percent relative to an untreated coal, e.g., less than 20 percent, with a 60 percent to a 100 percent reduction being sometimes observed. It is thought that the sulfur contained in the coal reacts with the calcium carbonate to produce calcium sulfate, thus reducing or eliminating the formation of $SO_2$. The calcium sulfate that is produced may be in the form of $CaSO_4.2H_2O$ (Gypsum). It should be recognized that the percent by weight of the calcium carbonate comprising the treated coal will typically vary depending on the percent by weight of sulfur in the untreated coal such that a desired molar ratio of Ca to S is achieved. Also, up to 50% of the sulfur in coal that is burned may remain in the fly ash and is not released as $SO_2$. Accordingly, a molar ratio of Ca to S less than 1 (e.g., 0.5) may be adequate for certain applications.

Another embodiment of the invention flows from the process described hereinbefore. This embodiment is a fractured coal with calcium carbonate deposited within fractures of the coal. The fractures, whether created by depressurization or pre-existing, are typically elongated and may be inter-connected or may be spaced apart in a generally parallel manner and may have cross section sizes in the range of 0.01 μm to 1 μm. The coal may be produced by the process discussed above and comprises calcium carbonate deposited within fractures of the coal such that the molar ratio of Ca to S is typically at least 0.5. In addition, the coal may comprise from about 0.15 percent by weight up to 2.5 percent by weight of silica within the fractures. The coal may further comprise calcium oxide deposited within the fractures, and this calcium oxide will contribute to achieving a desired molar ratio of Ca to S. As discussed previously, the type of coal that can be treated by the process is any coal that has an undesirable level of sulfur that will result in undesirable or illegal levels of $SO_2$ if burned without treatment and may have a sulfur content of about 0.2 percent by weight up to more than 7 percent by weight. The size of the coal that is treated may be about 2 inches down to less than about ¼ inch or may have reduced size by, for example, crushing, grinding or pulverizing the coal into a powder of particles having sizes less than about 5 cm, e.g., less than 3 cm, with sizes in the range of 50 μm to 100 μm being desirable for certain applications.

Still another embodiment of this invention is a process for producing energy from the combustion of coal while reducing the sulfur dioxide content of the emission from such combustion. The process comprises depositing calcium carbonate within fractures in the coal and burning the resulting calcium carbonate-containing coal at a high temperature to produce energy. In particular, calcium carbonate may be deposited within fractures in the coal in accordance with the process discussed hereinbefore using the aqueous silica colloid composition supersaturated with calcium carbonate, such that the calcium carbonate-containing coal comprises calcium carbonate deposited within fractures of the coal. The calcium carbonate-containing coal may be burned in accordance with a variety of techniques, including a variety of conventional techniques, to produce energy. For instance, the calcium carbonate-containing coal may be burned in accordance with fixed bed combustion (e.g., underfeed stoker fired process, traveling grate stoker fired process, or spreader stoker fired process), suspension firing (e.g., pulverized fuel firing or particle injection process), fluidized bed combustion (e.g., circulating fluidized bed combustion or pressurized fluidized bed combustion), magnetohydrodynamic generation of electricity, and so forth. The particular technique and equipment selected to burn the calcium carbonate-containing coal may affect one or more of the following characteristics associated with the burning step: (1) temperature encountered during burning (e.g., from about 1800° F. to about 4000° F.); (2) whether the calcium carbonate-containing coal is used in a wet form following deposition of the calcium carbonate or is first dried; (3) size of the calcium carbonate-containing coal used; and (4) amount of energy that can be produced. For instance, the calcium carbonate-containing coal may have a particle size less than about 1 inch and is burned in a Stoker furnace at about 2400° F. to about 2600° F. As another example, the calcium carbonate-containing coal may be powdered to particle sizes less than about 300 μm and is burned at about 3200° F. to about 3700° F. (e.g., about 3500° F.) by blowing it into a furnace, mixing it with a source of oxygen, and igniting the mixture in accordance with suspension firing.

Another embodiment of this invention is a process for increasing the amount of calcium sulfate produced as a result of burning high sulfur coal, while at the same time reducing the sulfur dioxide emissions from such burning. The process comprises burning coal having calcium carbonate deposited within fractures in the coal and recovering the calcium sulfate produced as a result of such burning. Calcium carbonate may be deposited within the fractures in accordance with the process discussed hereinbefore using the aqueous silica colloid composition supersaturated with calcium carbonate, and the coal may be burned in accordance with a variety of techniques as discussed hereinbefore. Depending on the technique used to burring the coal, one or more of a variety of combustion products may be produced, e.g., fly ash, bottom ash, boiler slag, and flue gas desulfurization material. Such combustion products may find use in a variety of applications, such as, for example, for cement, concrete, ceramics, plastic fillers, metal matrix composites, and carbon absorbents. For instance, fly ash from the burning of the coal in accordance with the present embodiment may be used in the production of cement. In particular, sulfur contained in the coal reacts with the calcium carbonate deposited within the fractures to produce calcium sulfate. As discussed previously, the calcium sulfate that is produced is typically in the form of gypsum ($CaSO_4.2H_2O$) that remains in the fly ash. This fly ash may be used as is or one or more separation processes known in the art may be used to extract $CaSO_4.2H_2O$ for use as a component of cement (e.g., Portland cement).

Another embodiment of the invention is an aqueous composition suitable for treating high sulfur coal to reduce the sulfur dioxide emissions when the treated coal is burned. The aqueous composition comprises a supersaturated solution of calcium carbonate integrated with an aqueous silica colloid composition, and optionally associated with calcium oxide. In particular, the aqueous composition may comprise about 2% w/v to 40% w/v sodium silicate or silica, about 15% w/v to 40% w/v calcium carbonate, and about 1.5% w/v to 4.0% w/v calcium oxide. As used herein, a 1% w/v of a substance denotes a concentration of the substance in a composition equivalent to 1 mg of the substance per 100 ml of the composition. A further embodiment of this invention is a process for making an aqueous composition suitable for treating high sulfur coal to reduce the sulfur dioxide emissions when the treated coal is burned, which process comprises dissolving calcium carbonate in a strong aqueous alkaline, silica colloid composition under conditions sufficient to integrate calcium ions into the silica-derived colloidal particles to form charged colloidal particles. For ease of discussion, these two embodiments will be discussed together.

Silica is also known as silicon dioxide ($SiO_2$) and comprises nearly sixty percent of the earth's crust, either in the free form (e.g., sand) or combined with other oxides in the form of silicates. Silica is not known to have any significant toxic effects when ingested in small quantities (as $SiO_2$ or as a silicate) by humans and is regularly found in drinking water in most public water systems throughout the United States. The basis of the composition useful in the present embodiments of the invention is the preparation of an alkaline, aqueous silica colloid composition, which can be referred to as a dispersion or a colloidal suspension.

The aqueous composition is prepared by dissolving particulate silica in highly alkaline water which is prepared by dissolving a strong base in water to provide an aqueous solution that is highly basic (i.e., a pH of more than 10, preferably at least 12, and more preferably at least 13.5). The strong base typically will be an alkali metal hydroxide, such as sodium hydroxide or potassium hydroxide, preferably the latter. A molar quantity of at least 3 will be used to prepare the alkaline solution with as much being used to maintain the pH at the desired level. Because the solubility (its ability to form a stable colloidal composition) of silica increases with increasing temperature, it is preferred that the alkaline solution be heated to a temperature above ambient, up to and including the boiling point of the solution. While temperatures above this may be employed, this is generally not preferred due to the need of a pressurized container. In dissolving silica in water made alkaline with sodium hydroxide, it is thought that a sodium silicate solution is formed. The composition will vary with respect to the varying ratios between sodium and silica, as will the density. The greater the ratio of $Na_2O$ to $SiO_2$ the greater is the alkalinity and the tackier the solution. Alternatively, the same end can be achieved by dissolving solid sodium silicate in water. Numerous aqueous sodium silicate colloidal compositions are available commercially at about 20% to about 50% w/v. A well-known solution is known as "egg preserver" which may be prepared by this method and is calculated to contain about 40% w/v of $Na_2\ Si_3O_7$ (a commonly available dry form of a sodium silicate). A standard commercially available sodium silicate is one that is 27% w/v sodium silicate.

While not wishing to be bound by any particular theory, it is believed that the chemistry of the dissolution of silica may be approximated in the following equations., $$SiO_2 + 2H_2O \underset{\text{Alkali NaOH}}{\overset{\text{Heat}}{\rightleftharpoons}} Si(OH)_4 \longleftrightarrow Si(ONa)_4 \quad (1)$$

$$Si(OH)_4 + OH \rightleftharpoons HSiO_3 + 2H_2O \quad (2)$$

$$2HSiO_3 \rightleftharpoons SiO_2 + 2H_2O \quad (3)$$

$$HSiO_3 + OH \rightleftharpoons SiO_3 + H_2O \quad (4)$$

Once the alkaline, silica colloid composition is prepared, an alkaline earth carbonate, preferably calcium carbonate, is added to the mixture, preferably as a finely divided powder. It is thought that the addition of the calcium carbonate aids in forming a stable colloidal composition having the calcium ions ($Ca^{+2}$) integrated into the colloidal structure. In addition, calcium oxide is also preferably added, which later is converted to $CaCO_3$ within fractures of a coal under the high pressure $CO_2$ atmosphere in the process discussed hereinbefore. The addition of the source of $Ca^{+2}$ ions through calcium carbonate (and calcium oxide) may be lead to polymerization of the $Si(OH)_4$ that may be visualized as follows:

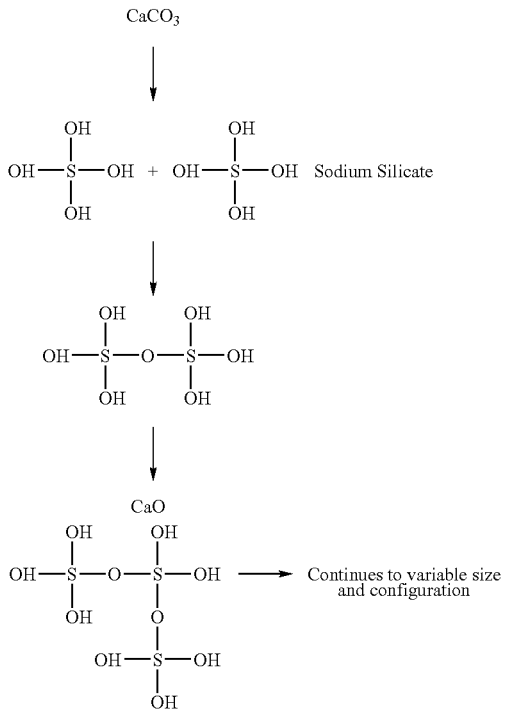

This is thought to lead to colloid particles in which $Ca^{+2}$ ions are sequested as, for example, shown in FIG. 1. Note that in FIG. 1 the base used would be potassium hydroxide, which provides the $K^+$ ions. The colloid formed in accordance with the present embodiments is thought to be more tightly bound and more extensively branched than known colloidal systems. It is further thought that FIG. 2 is representative of the typical double layer of water associated with a typical silica colloidal particle formed in accordance with this process. As shown in FIG. 2, the silica colloidal particle has a net negative charge and is surrounded by charged ions in the surrounding water. In the stem layer closest to the solid surface of the silica colloidal particle, the charged ions are mostly positively charged and may include $Ca^{+2}$ ions that are attracted to the negatively charged silica colloidal particle. It should be recognized that one or more $Ca^{+2}$ ions may be included within the interior of the silica colloidal particle.

During the preparation of the aqueous composition of this invention, it is preferably treated to increase the electrostatic charge on the silica colloidal particles. This is done by using a generator displayed in FIGS. 3 and 4. Further details may be found in U.S. patent application Ser. No. 09/749,243 to Holcomb, filed on Dec. 26, 2000 and published as US 2001/0027219 on Oct. 4, 2001, and in U.S. Pat. No. 5,537,363 to Holcomb, issued on Jul. 16, 1996, the disclosures of which are incorporated by reference herein in their entirety. The size and volumes in these publications and herein are for illustration only and are not limiting. The functioning of the generator entails a pump 1 which picks up the aqueous composition 5 which is disposed in container 3 and directs the aqueous composition 5 through conduit 2 and then through the pump 1. The pump 1 generates a velocity that depends on the size of the pump and pipes. This may be about 1 gallons per minute (gpm) to about 100 gpm (e.g., about 4 gpm to about 10 gpm in smaller systems) and a pressure of about 10 psi. The aqueous composition 5 at this aforementioned pressure and velocity flows through conduit 6 and enters conduit 7 that is surrounded by at least one concentric conduit (e.g., conduit 13). As shown in FIG. 2, the aqueous composition 5 flows through conduit 7 and exits through holes 8 into conduit 13 (e.g., a 1" pipe). The aqueous composition 5 then flows in the opposite direction through conduit 13, exits through holes 9, and reverses direction again through conduit 14 (e.g., a 1.5" pipe). The aqueous composition 5 exits conduit 14 through holes 10 into conduit 15, enters chamber 11, flows through conduit 12, and is carried back to container 3 through conduit 4.

Figure 4:
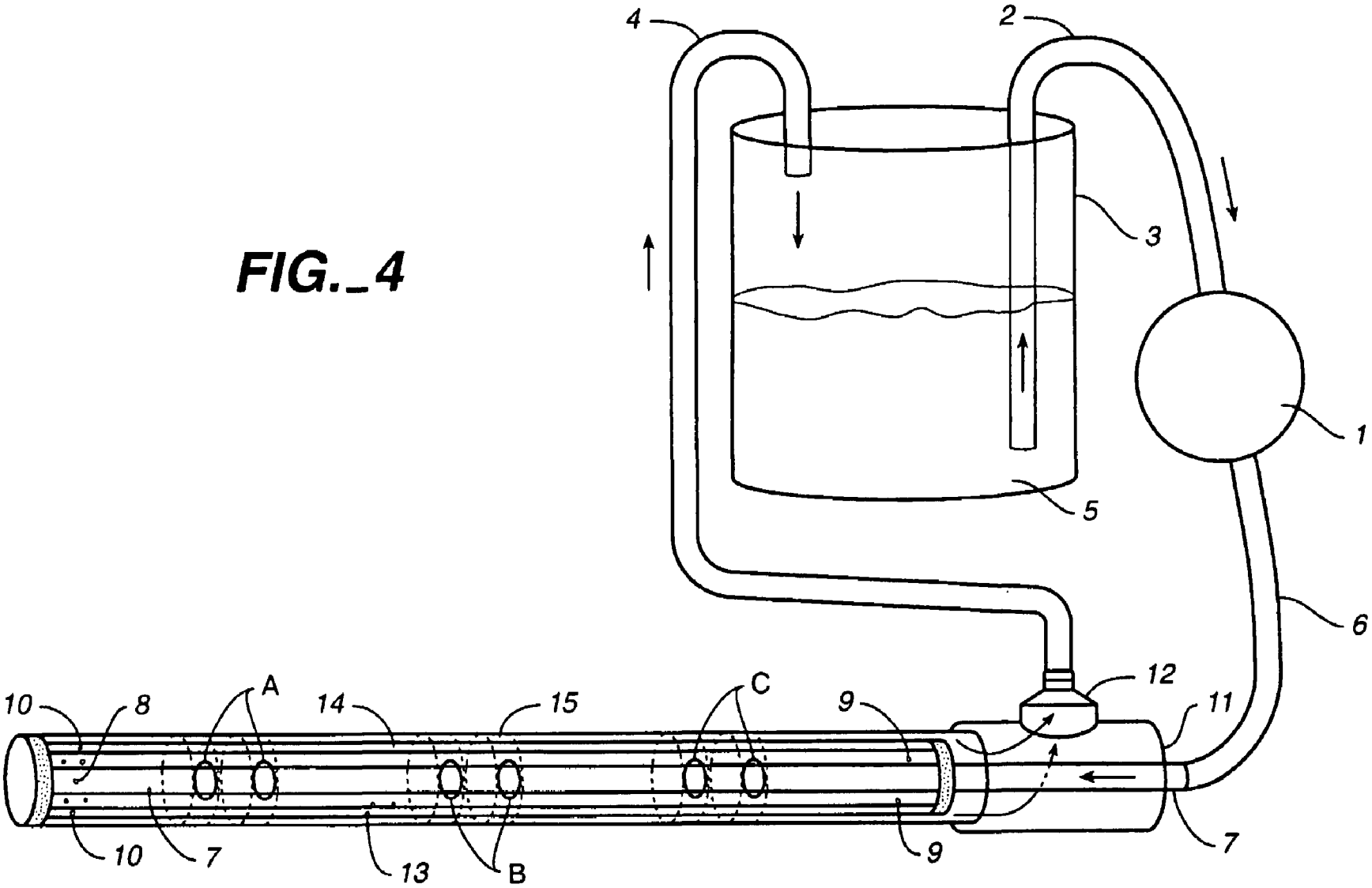
FIG. 4 is a representation of the generator of FIG. 3 in conjunction with three magnetic quadrupolar booster units, according to an embodiment of the invention.

Flow through the counter current device at a sufficient velocity and for a sufficient amount of time will generate the preferred composition according to the present embodiments of the invention because of a counter current charge effect. This counter current charge effect is thought to generate magnetic field gradients that in turn build up electrostatic charge on silica colloidal particles moving in the counter current process in the concentric conduits of the generator. This build up of electrostatic charge is thought to be associated with larger silica colloidal particles that are more stable and can in turn allow for a greater amount of calcium carbonate to be incorporated in the aqueous composition, e.g., by sequestering larger amounts of $Ca^{+2}$ ions. Preferably, one or more magnetic booster units are used to enhance this counter current charge effect by generating multiple bi-directional magnetic fields. FIG. 4 illustrates the function and location of the magnetic booster units that may be used with the generator displayed in FIG. 3. If one adds the magnetic booster units of FIG. 4 (units A, B and C), it has been observed that the electrostatic charge builds on the silica colloidal particles much faster. While three magnetic booster units are shown in FIG. 4, it should be recognized that more or fewer units may be used depending on the specific application. Typically, it is desired that two adjacent magnetic booster units (e.g., units A and B) are sufficiently spaced apart to reduce interaction between magnetic fields generating by the respective units.

Upper portion of FIG. 5 illustrates a top cross sectional view of the concentric conduits shown in FIG. 4. As can be noted from FIG. 5, a magnetic booster unit (e.g., unit A) comprises a plurality of magnets (e.g., electromagnets). Here, four magnets are shown arranged in a plane and form vertices of a quadrilateral shape (e.g., a rectangle or square) in that plane. Poles of adjacent magnets are of opposite orientation as indicated by the "+" and "−" signs shown in FIG. 5. As shown in the lower portion of FIG. 5, this arrangement of the four magnets creates multiple gradients for the magnetic field in the z axis (i.e., component of the magnetic field along axis extending out of the plane shown in the upper portion of FIG. 5). Here, measurements are shown for the magnetic field in the z axis along line A-A' that is displaced about an inch above the plane of the magnets. Gradients can also exist for the magnetic field in the x axis and y axis (i.e., component of magnetic field along lines A-A' and B-B'). These multiple gradients are responsible for the significant electrostatic charge that can build on the silica colloidal particle as the generator continues to process the aqueous composition. By treating the aqueous composition with the generator shown in FIG. 4, one can produce silica colloidal particles having sizes in the range of about 1 μm to about 200 μm, typically in the range of about 1 μm to about 150 μm or from about 1 μm to about 110 μm. The silica colloidal particles may have zeta potentials in the range of about −5 millivolts (mV) to over about −75 mV, and typically in the range of about −30 mV to about −50 or −60 mV. As one of ordinary skill in the art will understand, a zeta potential represents an electrostatic charge exhibited by a colloidal particle, and a zeta potential of greater magnitude typically corresponds to a more stable colloidal system (e.g., as a result of inter-particle repulsion).

Another embodiment of this invention is an apparatus for treating high sulfur coal with an aqueous composition under pressure. The apparatus comprises a pressurizable container suitable for holding the coal, a first inlet to allow the aqueous composition to enter the container and to contact with the coal, a mechanism to remove the aqueous composition from the container, a first inlet to allow carbon dioxide to enter the container under a pressure higher than atmospheric pressure, a source of pressurized carbon dioxide connected to the first inlet, and an outlet to remove the coal from the container.

Figure 6:
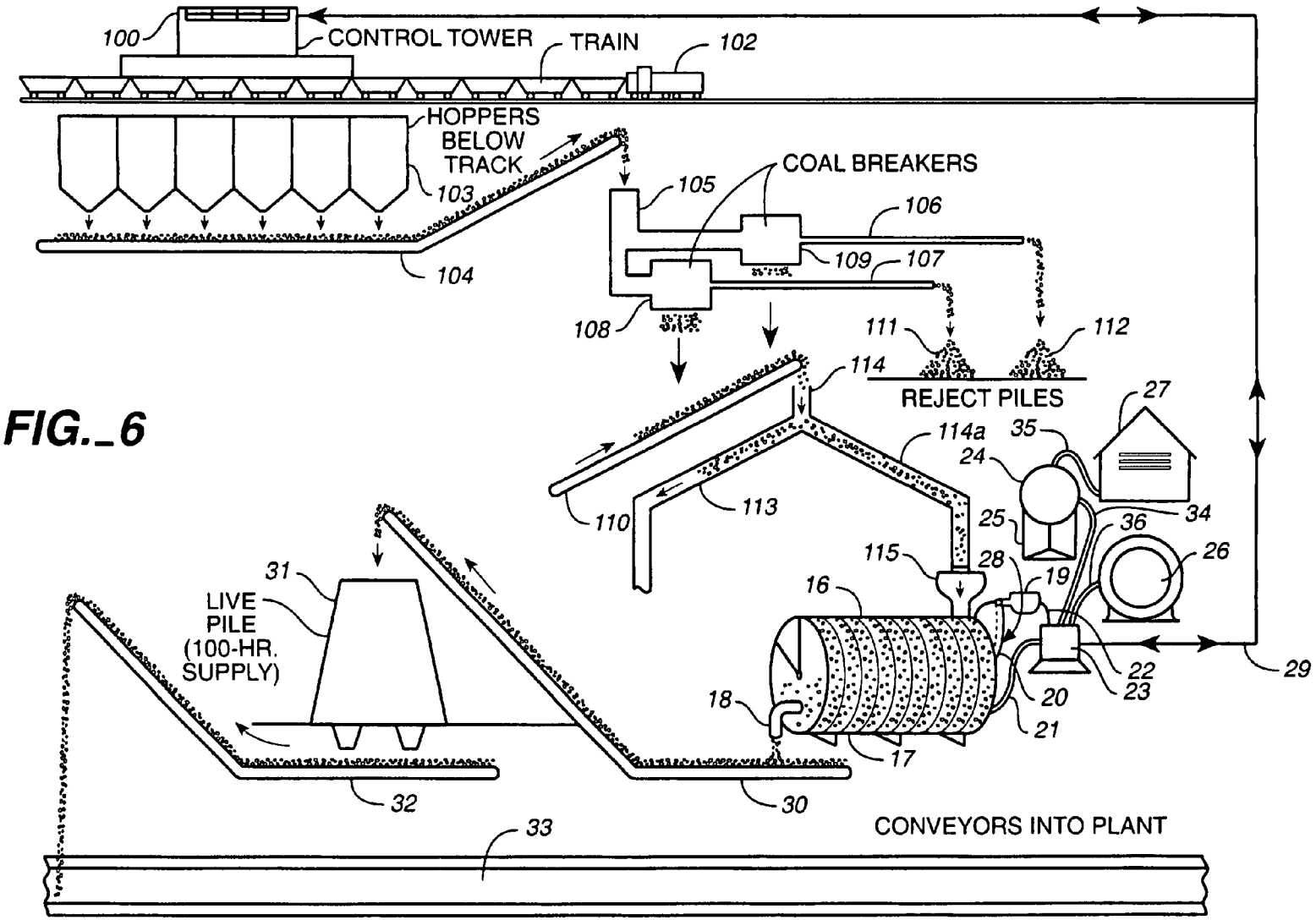
FIG. 6 is a representation of a process of taking high sulfur bituminous coal from rail cars through pre-preparation and treatment according to an embodiment of the invention.

This embodiment of the invention can be seen in the overall discussion of sequences shown in FIG. 6. Coal is brought to the steam generator plant via train cars 102 and dumped in the coal hoppers 103 underneath the control tower 100. Alternatively, the coal may be treated at the coal field instead of at the generator plant. The coal is then fed onto conveyor belt 104 and transported to coal breakers 108 and 109 via conduit 105. The low quality rejects and debris are transported to reject piles 111 and 112 via conduits 106 and 107. Coal is released from the breakers after being crushed to particles sized 1-2 mm in diameter. The coal falls on conveyor 110, which dumps it into conduit 114 then to conduits 113 and 114*a*. Conduit 114*a* carries the coal to hopper 115, which dumps the coal through a pressure batch into pressure tank 16. The pressure hatch is closed under hopper 115 and at the junction of exit conduit 18 with the pressure tank 16. As the coal is fed into tank 16 through hopper 115, auger 17 pushes the coal to the distal portion of the tank 16 as the tank 16 is tilted up to about 45°. The tank 16 is sealed and a vacuum (about 26" to 30" of water) is applied for 20 minutes by vacuum pump housed in 23, and the tank 16 is lowered back to neutral position. The aqueous composition of this invention, which may be synthesized in building 27, is pumped into storage tank 24 via conduit 35, then pumped via conduit 34 through conduit 21 and is drawn into tank 16 when valve is opened to the vacuum. The aqueous composition comprising silica colloidal particles, ionized calcium carbonate, calcium oxide, and water is drawn into the evacuated pores of the coal. After the system equilibrates, a remaining portion of the aqueous composition is removed, and valves are opened to allow $CO_2$ from tank 26 to flow via conduit 36 through controller 23 and then through conduit 21. A pressure of about 100-300 psi is maintained for up to an hour (e.g. 5-40 minutes) and released. The $CO_2$ pressure put an increased bicarbonate ion load into the pores of the coal. This increased availability of bicarbonate ion brings about crystallization of $CaCO_3$ in the pores of the coal thereby fracturing it and making more and larger pores available for penetration of calcium carbonate and calcium oxide. At this point the process is preferable repeated once or twice to maximize the integration of the silica calcium carbonate into the coal. Once fully processed, the resulting coal is then pushed out through conduit 18 by auger 17 onto belt 30 which carries the treated coal to "Live Pile" 31.

Figure 7:
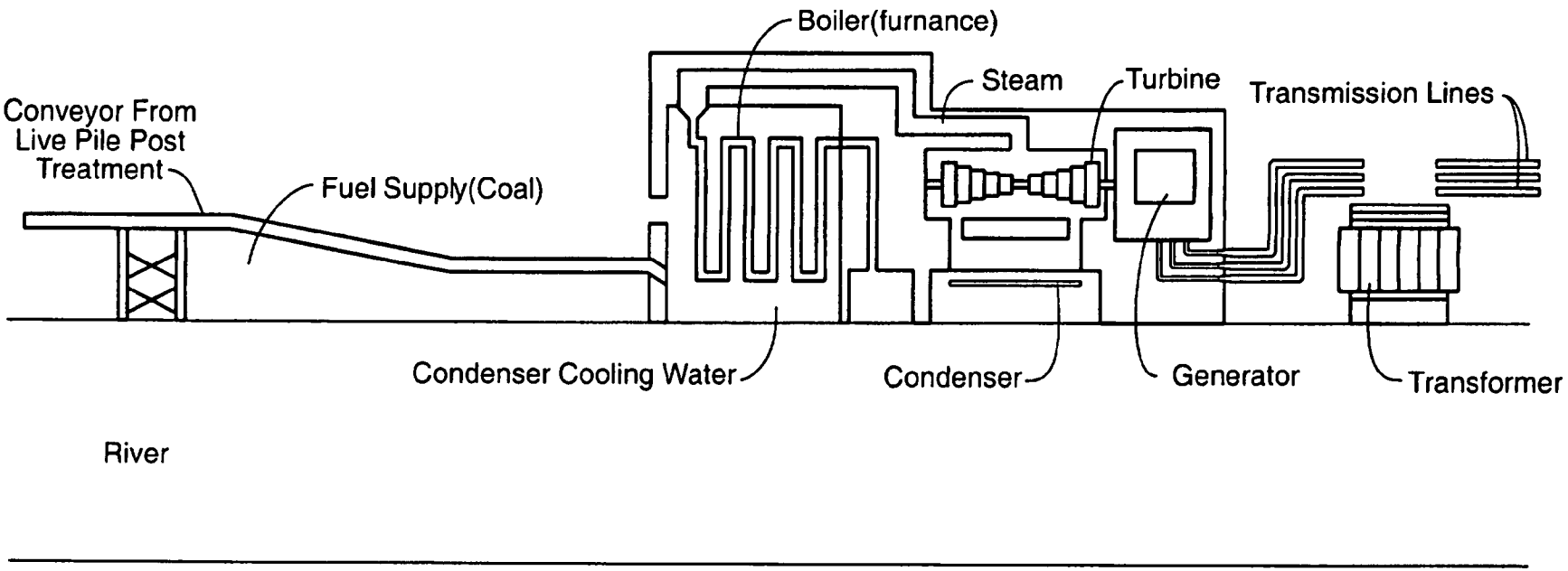
FIG. 7 is a representation of a steam plant that processes, burns and converts treated coal to heat energy, emissions, water and ash (including gypsum), according to an embodiment of the invention.
Figure 8:
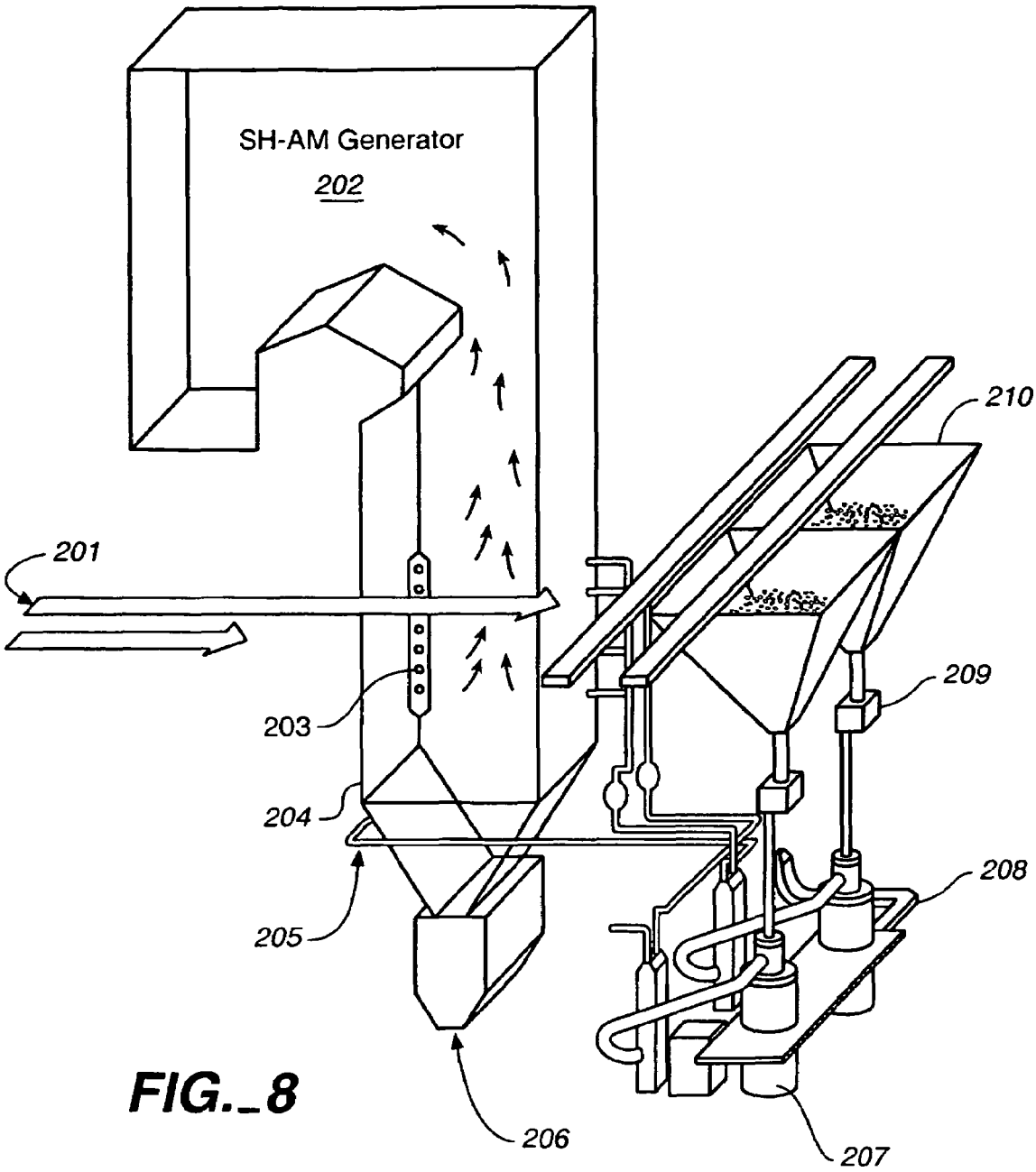
FIG. 8 is a representation of a high temperature furnace where treated coal is burned to produce heat energy that can be used to generate power, according to an embodiment of the invention.

The treated coal is released from "Live Pile" on belt 32 to conveyor 33. The treated coal may be burned as stoker coal in a stoker burner at temperatures of about 2400° F. to about 2600° F. or may be pulverized and burned in a blower furnace at temperatures of about 3200° F.-3700° F. As is seen in FIG. 7, the treated coal is carried to the furnace where it is burned. The burning coal heats water to steam, which drives turbines. The turbines in turn drive electric power generators that send power over the transmission lines. Alternatively, as shown in FIG. 8, the treated coal is delivered to the coal bunkers 210 over conveyor 201, which communicates with conveyor 33 of FIG. 6. Coal is metered on demand through scale 209 into pulverizers 207 to produce powdered coal. This powdered coal is directed through coal dust air line 205 and into furnace 204 through fuel injection nozzles 203. This powdered coal is blown into the furnace 204, where it ignites into an intense, swirling fire that burns at about 3500° Fahrenheit. At the time of the bum, calcium carbonate, calcium oxide, water and sulfur dioxide react in the presence of intense heat to form greater quantities of gypsum ($CaSO_4.2H_2O$) and lime which remains in the ash. The increased gypsum makes the ash of increased value for cement and it is removed for this use from ash bin 206. Therefore, high sulfur coal may be burned with greatly reduced emissions along with improved quality of combustion products. It is thought that the resulting ash also has a higher quantity of silicates particularly as microspheres. These microspheric silicates have high insulating properties that are useful for insulating paints, for example.

The following examples describe specific aspects of the invention to illustrate and provide a description of the invention for those of ordinary skill in the art. The examples should not be construed as limiting the invention, as the examples merely provide specific methodology useful in understanding and practicing the invention.

EXAMPLE I

This example describes a process for making an aqueous composition of this invention that is used for treating coal prior to burning. Five gallons of good quality water are placed into a container. The water is circulated through an electret generator (see U.S. patent application Ser. No. 09/749,243, above) at 4.5 to 5 gpm and 20 lbs/in$^2$ for one hour and discarded. 5 liters sodium silicate is placed in the generator as it continues to run at 4.5 to 5 gpm. This silicate is in a concentration of 27% w/v in 4.0 molar NaOH. After the sodium silicate is all in the system, the generator continues to run for one hour. Slowly, 615 grams of calcium carbonate is added as a slurry to the mixture for over 20 minutes. The generator is run for an additional hour under the same conditions. The pH at this point is greater than 10.0. The solution continues to run through the generator at 4.5 to 5 gpm as 500 grams of calcium oxide (CaO) is slowly added. The solution continues to run through the generator for an additional one hour. The material at this point is gray and a slightly cloudy, very dense colloid.

EXAMPLE II

This example describes a representative aqueous composition of this invention, along with a process for preparing it. The reference to the "generator" is to the device described in U.S. patent application Ser. No. 09/749,243 to Holcomb, filed on Dec. 26, 2000 and published as US 2001/0027219 on Oct. 4, 2001. The generator has a 150-gallon capacity and a flow rate of about 90-100 gallons per minute (gpm). The final composition exhibits a concentration of sodium silicate of about 40,000 ppm or 4% w/v.

42 gallons of water (pH 8.13) are added to the generator and circulated through the generator for 20 minutes. 8 gallons of sodium silicate (27% w/v concentration) are added to generator and circulated for 45 minutes. This provides a total of 50 gallons of sodium silicate solution having a pH of 12.20.

14.6 lb. of NaOH (sodium hydroxide) pellets are dissolved in 5 gallons of solution from the generator, and the resulting solution is added back into the generator. 2.5 Gallons of water is added to the generator and circulated for 90 minutes to give a composition having a pH of 13.84.

Twenty gallons of solution are pumped from the generator tank into a container, and 51.3 lb. of calcium carbonate are dissolved therein. The resulting solution is added back to the generator slowly over a 20-minute period. The composition is circulated for 20 minutes and shows a pH of 13.88. Again 20 gallons of solution is withdrawn from the generator, and an additional 51.3 lbs. of calcium carbonate are dissolved therein. The resulting composition is metered into the generator over a 20-minute period (pH 13.91). Additional circulation for 20 minutes provides a composition with a pH of 13.92.

Ten gallons of the resulting solution is withdrawn from the generator, and 5.5 lbs. of calcium oxide are added to container resulting in a slurry which is added back to generator over a 10-minute period of time. The resulting composition is circulated for 30 minutes (pH 13.98).

Twenty gallons of the circulating composition is added into a mixing barrel, and 1.0 Kg of ammonium chloride is slowly added with mixing. This composition is added back to generator over a 10-minute period and circulated for 30 minutes in the generator (pH 13.93).

The resulting composition of 55 gallons is placed in an appropriate container or containers for future use in treating coal in the process discussed herein. The consistency of the resulting composition is more viscous than water and appears to have a viscosity similar to that of a thin milk shake.

EXAMPLE III

This example provides representative details for carrying out the process of this invention for the treatment of coal.

Crushed coal is screened to small stoker size (less than about ½ inch), and 100 lb is weighed and placed into a 50 gallon barrel, the barrel is sealed and tumbled for 10 min to blend the coal. Coal is removed in 8 lb increments, in random fashion, and placed in two alternate containers: (a) control 50 lb and (b) for treatment 50 lb.

Five lb of calcium oxide is mixed with the 50 lb coal sample (b) and placed into the sample hopper of a pressure chamber, and the hopper is placed into pressure chamber. The pressure door is closed and tightened to seal. A vacuum is drawn (29"-30" of water) and maintained within the range for, 45 minutes.

A 4 gallon sample of the composition prepared in Example II is pulled into sample hopper with vacuum, and the system is allowed to equilibrate for 10 minutes. The vacuum is reversed by bleeding $CO_2$ into the chamber.

Excess liquid is removed from the coal and the chamber is resealed. Air is removed by vacuum and pressure is applied with $CO_2$ up to 300 psi (range 100 psi-300 psi). Pressure is retained for 30 minutes and released. These steps are repeated for two additional cycles.

Once complete excess liquid is removed and the coal is stored, transported or burned. In burning the coal the sulfur dioxide emissions appear to be reduced by about 95% to 100%. In conjunction with such reduction, one also sees reduction of about 40%-60% of $NO_x$ emissions, 40%-80% carbon monoxide emissions, 40%-60% hydrocarbon emissions, and 12%-16% carbon dioxide emissions. While not fully understanding the reasons for these reductions, it is thought that the silica may be playing some type of catalytic role to aid in the more complete combustion of the gases and formation of solids.

Each of the patent applications, patents, publications, and other published documents mentioned or referred to in this specification is herein incorporated by reference in its entirety, to the same extent as if each individual patent application, patent, publication, and other published document was specifically and individually indicated to be incorporated by reference.

While the present invention has been described with reference to the specific embodiments thereof, it should be understood by those skilled in the art that various changes may be made and equivalents may be substituted without departing from the true spirit and scope of the invention as defined by the appended claims. In addition, many modifications may be made to adapt a particular situation, material, composition of matter, method, process step or steps, to the objective, spirit and scope of the present invention. All such modifications are intended to be within the scope of the claims appended hereto. In particular, while the methods disclosed herein have been described with reference to particular steps performed in a particular order, it will be understood that these steps may be combined, sub-divided, or re-ordered to form an equivalent method without departing from the teachings of the present invention. Accordingly, unless specifically indicated herein, the order and grouping of the steps is not a limitation of the present invention.

The subject matter claimed is:

1. A process for treating high sulfur coal, which comprises at least 0.5 percent by weight sulfur, to reduce sulfur dioxide emissions when the coal is burned, which method comprises:

(a) placing the coal in an environment of reduced pressure sufficient to fracture a portion of the coal by withdrawing ambient fluids trapped within the coal, (b) contacting the fractured coal with an aqueous silica colloid composition supersaturated with calcium carbonate, (c) removing the majority of the aqueous composition from contact with the coal, and (d) pressurizing the aqueous composition-treated coal under a carbon dioxide atmosphere for a period of time sufficient for the calcium carbonate to enter fractures in the coal produced in step (a).

2. The process of claim 1, wherein the reduced pressure is about 26" to about 30" of water.

3. The process of claim 1, wherein prior to fracturing the coal, the coal is reduced to a size of less than about five centimeters (cm) maximum cross sectional distance.

4. The process of claim 3, wherein the coal is reduced to a size of less than about three cm maximum diameter.

5. The process of claim 4, wherein the coal is reduced to a size of about 50 microns (μm) to about 4 millimeters (mm).

6. The process of claim 5, wherein the coal is reduced to a size of about three mm to about four mm.

7. The process of claim 1, wherein the reduced pressure is maintained for up to an hour after it reaches its minimum while withdrawing the ambient fluids trapped within the coal.

8. The process of claim 7, wherein the reduced pressure is maintained for about 10 to about 45 minutes after it reaches its minimum.

9. The process of claim 1, wherein the carbon dioxide atmosphere is substantially pure carbon dioxide.

10. A high sulfur coal, wherein the coal is vacuum fractured, comprises at least about 0.5 percent by weight sulfur, and further comprises calcium carbonate deposited within fractures in the coal in an amount sufficient to provide a Ca:S molar ratio of at least 0.5.

11. The high sulfur coal of claim 1, wherein the sulfur content is about 0.5 percent to about 7.0 percent by weight sulfur and the calcium carbonate deposited within the fractures in the coal is in an amount sufficient to provide a Ca:S molar ratio of about 1 to 4.

12. The high sulfur coal of claim 11, wherein the coal further comprises silica present at a level of at least 0.15% by weight.

13. A process for producing energy from burning high sulfur coal of at least 0.5 percent by weight sulfur while reducing the sulfur dioxide content of the emission from such burning, which process comprises depositing calcium carbonate within fractures in vacuum-fractured coal and burning the resulting calcium carbonate-containing high sulfur coal at a high temperature of about 2400-2600° Fahrenheit or about 3200-3700° Fahrenheit, wherein the calcium carbonate is deposited within the fractures of the coal in accordance with the process of (a) placing the coal in an environment of reduced pressure sufficient to fracture a portion of the coal by withdrawing ambient fluids trapped within the coal, (b) contacting the fractured coal with an aqueous silica colloid composition supersaturated with calcium carbonate, (c) removing the majority of the aqueous composition from contact with the coal, and (d) pressurizing the aqueous composition-treated coal under a carbon dioxide atmosphere for a period of time sufficient for the calcium carbonate to enter fractures in the coal produced in step (a).

14. The process of claim 13, wherein the coal has a particle size of less than 5 centimeters.

15. The process of claim 14, wherein the coal has a particle size of about 50 mm to about 2 mm.

16. The process of claim 13, wherein the coal is powdered and is burned at a temperature of about 3200° Fahrenheit to about 3700° Fahrenheit by blowing it into a furnace, mixing it with a source of oxygen, and igniting the mixture.

17. The process of claim 16, wherein the temperature is about 3500° Fahrenheit.

* * * * *